US011535908B2

(12) United States Patent
Na et al.

(10) Patent No.: US 11,535,908 B2
(45) Date of Patent: Dec. 27, 2022

(54) HOT-ROLLED STEEL SHEET HAVING EXCELLENT DURABILITY AND METHOD FOR MANUFACTURING SAME

(71) Applicant: POSCO, Pohang-si (KR)

(72) Inventors: Hyun-Taek Na, Gwangyang-si (KR); Seok-Jong Seo, Gwangyang-si (KR)

(73) Assignee: POSCO HOLDINGS INC., Seoul (KR)

( * ) Notice: Subject to any disclaimer, the term of this patent is extended or adjusted under 35 U.S.C. 154(b) by 272 days.

(21) Appl. No.: 16/955,529

(22) PCT Filed: Nov. 15, 2018

(86) PCT No.: PCT/KR2018/013951

§ 371 (c)(1),
(2) Date: Jun. 18, 2020

(87) PCT Pub. No.: WO2019/124747

PCT Pub. Date: Jun. 27, 2019

(65) Prior Publication Data

US 2021/0010098 A1 Jan. 14, 2021

(30) Foreign Application Priority Data

Dec. 21, 2017 (KR) ..... 10-2017-0177515

(51) Int. Cl.

| | |
|---|---|
| ***C21D 9/46*** | (2006.01) |
| ***C22C 38/28*** | (2006.01) |
| ***C22C 38/26*** | (2006.01) |
| ***C22C 38/24*** | (2006.01) |
| ***C22C 38/06*** | (2006.01) |
| ***C22C 38/02*** | (2006.01) |

(Continued)

(52) U.S. Cl.

CPC ..... *C21D 9/46* (2013.01); *C21D 6/002* (2013.01); *C21D 6/005* (2013.01); *C21D 6/008* (2013.01);

(Continued)

(58) Field of Classification Search

CPC ..... C21D 2211/002; C21D 221/004; C21D 2211/005; C21D 2211/008; C21D 6/002;

(Continued)

(56) References Cited

U.S. PATENT DOCUMENTS

| | | | |
|---|---|---|---|
| 2014/0161659 A1 | 6/2014 | Murakami et al. | |
| 2015/0292054 A1 | 10/2015 | Kami et al. | |
| 2019/0323103 A1 | 10/2019 | Seo et al. | |

FOREIGN PATENT DOCUMENTS

| | | | | |
|---|---|---|---|---|
| CN | 103732779 A | * | 4/2014 | ..... C21D 8/0226 |
| CN | 103732779 A | | 4/2014 | |

(Continued)

OTHER PUBLICATIONS

Extended European Search Report dated Nov. 20, 2020 issued in European Patent Application No. 18891809.8.

(Continued)

*Primary Examiner* — Jenny R Wu

(74) *Attorney, Agent, or Firm* — Morgan, Lewis & Bockius LLP

(57) ABSTRACT

The present invention relates to steel used for a sash component and the like of a vehicle and, more specifically, to a hot-rolled steel sheet having excellent durability and a method for manufacturing same, the hot-rolled steel sheet having no cracks formed on a material and a welding heat-affected zone (HAZ) even after pipemaking and molding due to a smaller decrease in the strength of the welding heat-affected zone formed during electric resistance welding in comparison with the strength of the material (base material).

8 Claims, 2 Drawing Sheets

(a)

(b)

(51) Int. Cl.

| | |
|---|---|
| ***C22C 38/00*** | (2006.01) |
| ***C21D 8/02*** | (2006.01) |
| ***C21D 6/00*** | (2006.01) |
| ***C22C 38/38*** | (2006.01) |
| *C21D 9/08* | (2006.01) |

(52) U.S. Cl.
CPC ..... *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/24* (2013.01); *C22C 38/26* (2013.01); *C22C 38/28* (2013.01); *C22C 38/38* (2013.01); *C21D 9/085* (2013.01); *C21D 2211/002* (2013.01); *C21D 2211/005* (2013.01); *C21D 2211/008* (2013.01)

(58) Field of Classification Search
CPC ..... C21D 6/005; C21D 6/008; C21D 8/0205; C21D 8/021; C21D 8/0226; C21D 8/0263; C21D 9/085; C21D 9/46; C22C 38/001; C22C 38/002; C22C 38/02; C22C 38/04; C22C 38/06; C22C 38/24; C22C 38/26; C22C 38/28; C22C 38/38
See application file for complete search history.

(56) References Cited

FOREIGN PATENT DOCUMENTS

| | | | | |
|---|---|---|---|---|
| EP | 1398392 | A1 | | 3/2004 |
| JP | H07-150247 | A | | 6/1995 |
| JP | 2000-063955 | A | | 2/2000 |
| JP | 2007-177325 | A | | 7/2007 |
| JP | 2009-019214 | A | | 1/2009 |
| JP | 2009-057620 | A | | 3/2009 |
| JP | 2009-270171 | A | | 11/2009 |
| JP | 2013-040380 | A | | 2/2013 |
| JP | 2017125245 | A | * | 7/2017 |
| KR | 10-2003-0020391 | A | | 3/2003 |
| KR | 10-2014-0012490 | A | | 2/2014 |
| KR | 10-2014-0118315 | A | | 10/2014 |
| KR | 10-2014-0138854 | A | | 12/2014 |
| KR | 10-2015-0051839 | A | | 5/2015 |
| KR | 10-2016-0089316 | A | | 7/2016 |
| KR | 10-1657403 | B1 | | 9/2016 |
| KR | 10-1858853 | B1 | | 6/2018 |
| WO | 00/39352 | A2 | | 7/2000 |

OTHER PUBLICATIONS

Japanese Office Action dated Sep. 7, 2021 issued in Japanese Patent Application No. 2020-533705.

Chinese Office Action dated Jun. 1, 2021 issued in Chinese Patent Application No. 201880082722.2.

T. Fengzhao, "Engineering Materials," Feb. 28, 1987, pp. 226-228 (with English Abstract).

International Search Report dated Feb. 22, 2019 issued in International Patent Application No. PCT/KR2018/013951—(along with English translation).

* cited by examiner

【FIG. 1】
(a)
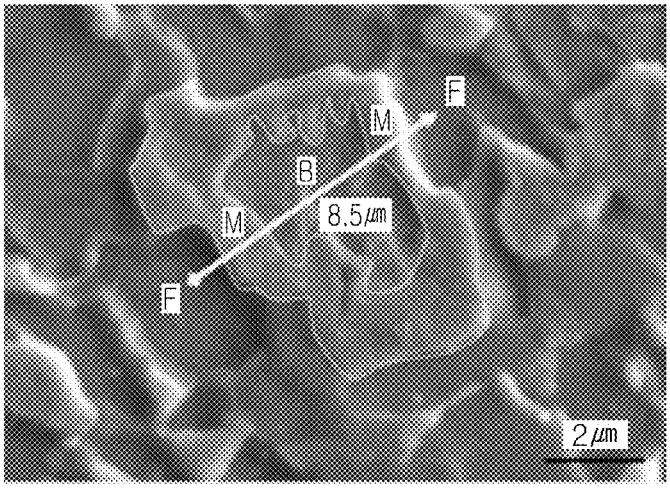
(b)
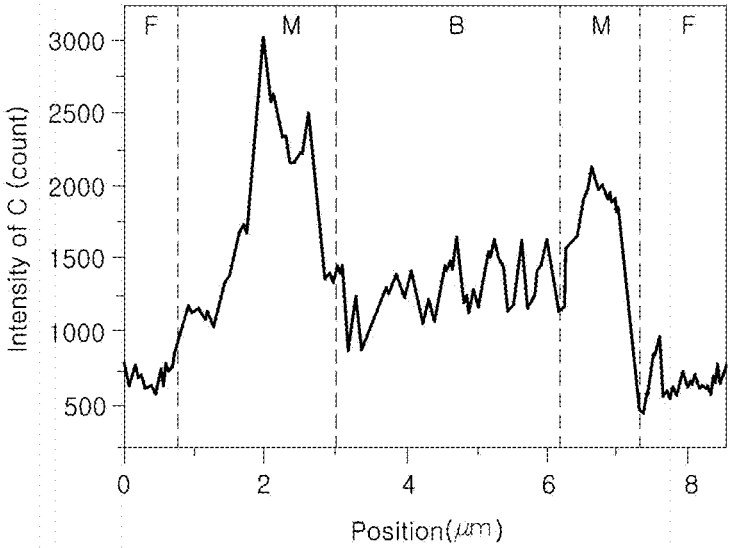

【FIG. 2】
(a)
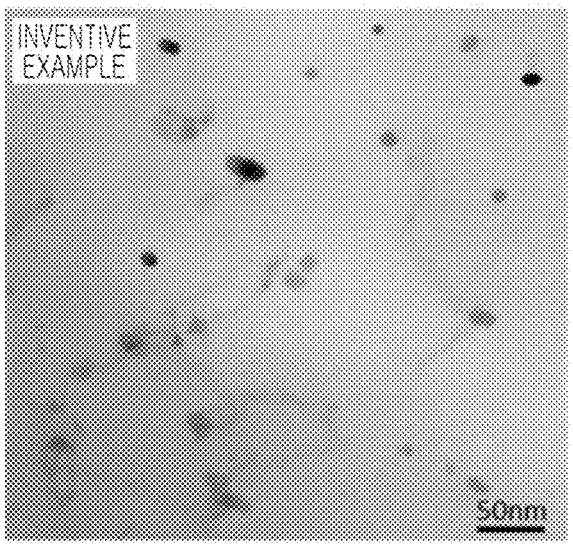
(b)
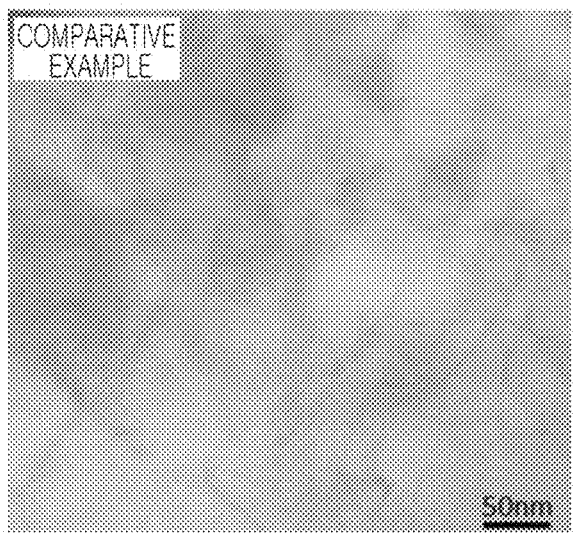

HOT-ROLLED STEEL SHEET HAVING EXCELLENT DURABILITY AND METHOD FOR MANUFACTURING SAME

CROSS-REFERENCE OF RELATED APPLICATIONS

This application is the U.S. National Phase under 35 U.S.C. § 371 of International Patent Application No. PCT/KR2018/013951, filed on Nov. 15, 2018, which in turn claims the benefit of Korean Application No. 10-2017-0177515, filed on Dec. 21, 2017, the entire disclosures of which applications are incorporated by reference herein.

TECHNICAL FIELD

The present disclosure relates to steel used for a sash component, and the like, of a vehicle, and more specifically, to a hot-rolled steel sheet having excellent durability used for an electric-resistance-welded steel pipe and a method for manufacturing the same.

BACKGROUND ART

Recently, the automobile industry has increasingly employed a high strength steel material which may secure both fuel efficiency and impact safety with low prime costs to restrict fuel efficiency for environmental preservation on earth and to secure the impact stability of passengers. The movement for reduction of weight has been applied to a vehicle body and also to a sash component.

Generally, as properties required for a steel material used for a vehicle body, there may be a strength, an elongation rate for forming, and spot weldability required for assembly, and the like.

Meanwhile, a steel material used for a sash component requires arc weldability applied in assembling of components, and fatigue properties for securing durability quality of a component, in addition to a strength and an elongation rate required for forming, in consideration of characteristics of the component.

As for a component such as a coupled torsion beam axle (CTBA) among sash components, a hollow pipe may be formed and used to secure both stiffness and reduction of weight, and for additional reduction of weight, a material has been designed to have high strength.

As described above, as for a material used for a pipe member, since a pipe may be manufactured through electric resistance welding in general, rolling-forming of a material in pipemaking, and cold-rolling formability after pipemaking to make a pipe may be important along with electric resistance weldability. Thus, as for properties which such a material should have, it may be important to secure integrity of a welded zone in electric resistance welding. The reason is that most fractures may be concentrated in a welded zone or a welding heat affected zone as compared to a base material due to deformation in forming of an electric resistance welded steel pipe.

To improve roll-formability in pipemaking of a material, it may be advantageous to decrease a yield ratio of a material as much as possible. When the material is a high strength steel material, yield strength may be high such that, when a yield ratio increases, spring-back may increase in roll-forming, which may lead to a problem in which it may be difficult to secure out-of-roundness.

Also, consequently, to perform cold-forming using a pipe, it may be necessary to secure an elongation rate of a material, and to satisfy this, a steel material having a low yield ratio and an excellent elongation rate may be basically required.

A hot-rolled steel sheet used for a hollow pipe of the prior art is two-phase composite steel of ferrite-martensite in general, and the steel exhibits continuous yield behavior and low yield strength properties by moving dislocation introduced in martensite transformation, and may have an excellent elongation rate.

To secure such properties, in the prior art, steel is controlled to have a component system containing a large amount of Si in steel so as to stably secure a fraction of ferrite in cooling after hot-rolling. However, when a pipe is manufactured using an electric resistance welding method, a large amount of Si oxide may be formed in a molten zone such that there may be a problem in which a penetrator defect may occur in a welded zone. Also, martensite may be obtained by rapid cooling to a temperature equal to or lower than a martensite transformation initiation temperature (Ms) after ferrite transformation, and in this case, when a retained phase is only formed of pure martensite, there may be a problem in which reduction of strength caused by heat in welding may increase. Particularly, hardness reduction (ΔHv) of a welding heat affected zone may exceed 30.

Also, a ferrite-martensite structure may have an advantageous aspect in terms of decreasing a yield ratio, but microcracks may be easily created on a boundary between phases due to a high difference in hardness between two phases such that durability may be deteriorated.

(Reference 1) Japanese Laid-Open Patent Publication No. 2000-063955

DISCLOSURE

Technical Problem

An aspect of the present disclosure is to provide a hot-rolled steel sheet having excellent durability with no cracks formed in a material and a welding heat affected zone (HAZ) even after pipemaking and forming due to a less decrease of strength of a welding heat affected zone, formed during electric resistance welding, as compared to strength of a material (base material).

Technical Solution

An aspect of the present disclosure provides a hot-rolled steel sheet having excellent durability including, by weight %, 0.05-0.14% of carbon (C), 0.1-1.0% of silicon (Si), 0.8-1.8% of manganese (Mn), 0.001-0.03% of phosphorous (P), 0.001-0.01% of sulfur (S), 0.1-0.5% of soluble aluminum (Sol.Al), 0.3-1.0% of chromium (Cr), 0.01-0.05% of titanium (Ti), 0.03-0.06% of niobium (Nb), 0.04-0.1% of vanadium (V), 0.001-0.01% of nitrogen (N), and a balance of Fe and inevitable impurities, wherein Mn and Si satisfy relational formula 1 as below, wherein a microstructure includes a hard phase including martensite and bainite phases mixed therein with a ferrite phase as a matrix structure, and wherein in a total fracture (area fraction) of a hard phase, a fraction of grains in which a martensite phase and a bainite phase are mixed in a single grain is 60% or higher, and relational formula 2 as below is satisfied.

$$4<Mn/Si<12 \quad \text{[Relational Formula 1]}$$

(where Mn and Si refer to weight contents of respective elements)

$$SSG_{M+B}/(M+B+SSG_{M+B})\geq 0.6 \quad \text{[Relational Formula 2]}$$

(where M refers to a martensite phase, B refers to a bainite phase, and $SSG_{M+B}$ refers to a hard phase in which B and M phases are mixed in a single grain, a structure in which an M phase is present around a grain boundary, and a B phase is present in a central region. Also, each phase is represented by area fraction (%)).

Another aspect of the present disclosure provides a method of manufacturing a hot-rolled steel sheet having excellent durability, the method including reheating a steel slab satisfying the above-described alloy composition and relational formula 1 at a temperature range of 1180-1300° C.; finishing hot-rolling the reheated steel slab at a temperature of Ar3 or higher and manufacturing a hot-rolled steel sheet; primarily cooling the hot-rolled steel sheet to a temperature range of 550-750° C. at a cooling rate of 20° C./s or higher; performing secondary cooling at a cooling rate of 0.05-2.0° C./s within a range in which relational formula 4 is satisfied, after the primary cooling; performing tertiary cooling to a temperature range of room temperature-400° C. at a cooling rate of 20° C./s or higher, after the secondary cooling; and performing coiling after the tertiary cooling.

$$|t-ta|\leq 2 \qquad \text{[Relational Formula 4]}$$

(with respect to the relational formula, [ta=251+(109[C])+(10.5[Mn])+(22.7[Cr])−(6.1[Si])−(5.4[Sol.Al])−(0.87Temp)+(0.00068Temp^2)] is amended to [ta=251+(109[C])+(10.5[Mn])+(22.7[Cr])−(6.1[Si])−(5.4[Sol.Al])−(0.87Temp)+(0.00068Temp$^2$)], where t refers to a secondary cooling maintaining time (seconds), ta refers to a secondary cooling maintaining time (seconds) for securing an optimal phase fracture, and Temp refers to a secondary cooling intermediate temperature, a temperature of an intermediate point between a secondary cooling initiation point and a secondary cooling termination point. Also, each alloy composition is represented by weight content)

Another aspect of the present disclosure provides an electric resistance welded steel pipe having excellent durability manufactured by electric resistance welding the hot-rolled steel sheet described above.

Advantageous Effects

According to the present disclosure, a hot-rolled steel sheet having high strength, having tensile strength of 590 MPa or higher, may be provided, and an effect of significantly reducing a strength softening phenomenon in a welding heat affected zone in electric resistance welding of the hot-rolled steel sheet may be obtained.

Also, no cracks may be created in a material or a welding heat affected zone even after pipemaking after welding, and forming, and excellent durability may be secured.

DESCRIPTION OF DRAWINGS

FIG. 1 is an image (a) of a shape of a structure occupying 60% in area ratio of a total hard phase and distribution (b) of a content of carbon (C) measured in each section of the structure of inventive example 5 using an electro probe x-ray micro analyzer (EPMA) according to an example embodiment of the present disclosure.

FIG. 2 is images of ferrite phases of inventive example 5(a) and comparative example 14(b) according to an example embodiment of the present disclosure.

BEST MODE FOR INVENTION

The inventors conducted research to manufacture a hot-rolled steel sheet of which a yield ratio is controlled to be less than 0.85 such that roll-forming for pipemaking may be easily performed, which may exhibit a uniform process hardening phenomenon in a direction of a thickness of a steel sheet in forming after the pipemaking, and which may have excellent durability, having 590 MPa level strength, as a decrease of hardness of an electric resistance welding heat affected zone is low.

As a result, a microstructure which may be advantageous to securing the above-described properties may be formed by optimizing an alloy composition of a steel material and manufacturing conditions thereof, and accordingly, it has been confirmed that a hot-rolled steel sheet having high strength and excellent durability may be provided, and the present disclosure has been completed.

In the description below, the present disclosure will be described in detail.

A hot-rolled steel sheet having excellent durability according to an aspect of the present disclosure may include, by weight %, 0.05-0.14% of carbon (C), 0.1-1.0% of silicon (Si), 0.8-1.8% of manganese (Mn), 0.001-0.03% of phosphorous (P), 0.001-0.01% of sulfur (S), 0.1-0.5% of soluble aluminum (Sol.Al), 0.3-1.0% of chromium (Cr), 0.01-0.05% of titanium (Ti), 0.03-0.06% of niobium (Nb), 0.04-0.1% of vanadium (V), and 0.001-0.01% of nitrogen (N), preferably.

In the description below, the reasons why an alloy composition of a hot-rolled steel sheet provided in the present disclosure is limited as above will be described in detail. In the description, a content of each element will be represented by weight % unless otherwise indicated.

C: 0.05-0.14%

Carbon (C) may be the most economical and effective for strengthening steel. When a content thereof increases, a fraction of a low temperature transformation phase, such as bainite and martensite, may increase in composite steel including ferrite, bainite, and martensite such that tensile strength may improve.

In the present disclosure, when a content of C is less than 0.05%, the formation of a low temperature transformation phase may not be easily performed in cooling after hot-rolling such that a target level of strength may not be secured. When a content thereof exceeds 0.14%, there may be problems in which strength may excessively increase, and that weldability, formability, and toughness may be degraded.

Thus, in the present disclosure, it may be preferable to control a content of C to be 0.05-0.14%, and more preferably, a content thereof may be controlled to be 0.07-0.13%.

Si: 0.1-1.0%

Silicon (Si) may deoxidize molten steel and may have a solid solution strengthening effect. As silicon (Si) may be a ferrite stabilizing element, silicon (Si) may facilitate ferrite transformation in cooling after hot-rolling. Thus, silicon (Si) may be effective for increasing a ferrite fraction included in a matrix of ferrite, bainite, and martensite composite steel.

When a content of Si is less than 0.1%, a ferrite stabilizing effect may be low such that it may be difficult to form a matrix structure as a ferrite structure. When a content thereof exceeds 1.0%, red scales caused by Si may be formed on a surface of a steel sheet in hot-rolling such that surface quality of the steel sheet may be greatly deteriorated, and ductility and electric resistance weldability may also be degraded, which may be problems.

Thus, in the present disclosure, it may be preferable to control a content of Si to be 0.1-1.0%, and more preferably, a content thereof may be controlled to be 0.15-0.8%.

Mn: 0.8-1.8%

Manganese (Mn) may be effective for strengthening solid solution of steel similarly to Si, and may increase hardenability of steel such that a bainite or martensite phase may be easily formed in cooling after hot-rolling.

When a content thereof is less than 0.8%, the above-described effect may not be sufficiently obtained. When a content thereof exceeds 1.8%, ferrite transformation may be excessively delayed such that there may be a difficulty in securing an appropriate fraction of a ferrite phase, and a segregation region may be greatly developed in a central portion of a thickness in casting a slab in a continuous casting process such that electric resistance weldability of a final product may be degraded, which may be a problem.

Thus, in the present disclosure, it may be preferable to control a content of Mn to be 0.8-1.8%, and more preferably, it may be advantageous to control a content thereof to be 1.0-1.75%.

P: 0.001-0.03%

Phosphorous (P) may be one or impurities present in steel. When a content thereof exceeds 0.03%, ductility may be degraded by micro-segregation and impact properties of steel may be deteriorated. To manufacture steel to include less than 0.001% of P, however, a great amount of time may be consumed in a steel making operation such that productivity may greatly decrease, which may be a problem.

Thus, in the present disclosure, it may be preferable to control a content of P to be 0.001-0.03%.

S: 0.001-0.01%

Sulfur (S) may be one of impurities present in steel. When a content thereof exceeds 0.01%, sulfur (S) form a non-metal inclusion by being combined with Mn, and accordingly, toughness of steel may greatly degrade, which may be a problem. A great amount of time may be consumed, however, to manufacture steel to include less than 0.001% of S in a steel making operation such that productivity may greatly decrease, which may be a problem.

Thus, in the present disclosure, it may be preferable to control a content of S to be 0.001-0.01%.

Sol.Al: 0.1-0.5%

Soluble aluminum (Sol.Al) may be a ferrite stabilizing element, and may be effective for forming a ferrite phase in cooling after hot-rolling.

When a content of Sol.Al is less than 0.1%, an effect of adding Sol.Al may be insufficient such that there may be a problem in which it may be difficult to secure ductility of a high strength steel material. When a content thereof exceeds 0.5%, a defect may easily occur in a slab in continuous casting, and a surface defect may occur after hot-rolling such that surface quality may degrade.

Thus, in the present disclosure, it may be preferable to control a content of Sol.Al to be 0.1-0.5%, and more preferably, a content thereof may be controlled to be 0.2-0.4%.

Cr: 0.3-1.0%

Chromium (Cr) may make steel solid-solution strengthened, and may delay transformation of a ferrite phase in cooling similarly to Mn such that chromium (Cr) may be advantageous to forming martensite.

When a content of Cr is less than 0.3%, the above-described effect may not be sufficiently obtained. When a content thereof exceeds 1.0%, ferrite transformation may be excessively delayed, and a fraction of a low temperature transformation phase such as bainite or martensite phases may unnecessarily and excessively increase such that an elongation rate may be rapidly deteriorated, which may be a problem.

Thus, in the present disclosure, it may be preferable to control a content of Cr to be 0.3-1.0%, and more preferably, a content thereof may be controlled to be 0.4-0.8%.

Ti: 0.01-0.05%

Titanium (Ti) may form a coarse precipitate by being combined with nitrogen (N) in continuous casting. A portion of titanium (Ti) may not be re-solute in reheating for a hot-rolling process and may remain in a material, and the precipitate which has not been re-solute may have a high melting point and may not be re-solute even in welding, and accordingly, the precipitate may prevent grain growth of a welding heat affected zone. Also, re-solute Ti may be finely precipitated in a phase transformation process during a cooling process after hot-rolling and may have an effect of greatly improving strength of steel.

To sufficiently obtain the above-described effect, it may be preferable to contain 0.01% or higher of Ti. When a content thereof exceeds 0.05%, a yield ratio of steel may increase by a precipitate which has been finely precipitated such that it may be difficult to perform roll-forming in pipe making, which may be a problem.

Thus, in the present disclosure, it may be preferable to control a content of Ti to be 0.01-0.05%.

Nb: 0.03-0.06%

Niobium (Nb) may improve strength by forming a carbonitride precipitate, and particularly, a precipitate which has been finely precipitate in a ferrite grain in a phase transformation process in a cooling process after hot-rolling may greatly improve strength of steel.

When a content of Nb is less than 0.03%, a sufficient precipitation effect may not be secured. When a content thereof exceeds 0.06%, excessive precipitation may occur such that an yield ratio of steel may increase, and an excessively elongated structure may be formed, which may deteriorate pipemaking properties.

Thus, in the present disclosure, it may be preferable to control a content of Nb to be 0.03-0.06%.

V: 0.04-0.1%

Vanadium (V) may improve strength by forming a carbonitride precipitate, and particularly, a precipitate which has been finely precipitate in a ferrite grain in a phase transformation process in a cooling process after hot-rolling may greatly improve strength of steel.

When a content of V is less than 0.04%, a sufficient precipitation effect may not be obtained. When a content thereof exceeds 0.1%, excessive precipitation may occur such that an yield ratio of steel may increase, and it may be difficult to perform roll-forming in pipe making, which not be preferable.

Thus, in the present disclosure, it may be preferable to control a content of V to be 0.04-0.1%.

N: 0.001-0.01%

Nitrogen (N) may be a representative solid solution strengthening element along with C, and may form a coarse precipitate with Ti, Al, and the like.

Generally, a solid solution strengthening effect of N may be more excellent than that of C, but the more the amount of N in steel increases, the more the toughness may greatly degrade, which may be a problem. Thus, in the present disclosure, it may be preferable to control an upper limit of N to be 0.01%. A large amount of time may be consumed, however, to manufacture steel to include less than 0.001% of N in a steel making operation such that productivity may degrade.

Thus, in the present disclosure, it may be preferable to control a content of N to be 0.001-0.01%.

In the present disclosure, manganese (Mn) and silicon (Si) controlled to have the above-described contents may satisfy relational formula 1 as below, preferably.

$$4<Mn/Si<12 \quad \text{[Relational Formula 1]}$$

(in the relational formula, Mn and Si refer to weight contents of respective elements)

When a value of relational formula 1 is 4 or smaller or 12 or higher, when an electric resistance welded steel pipe is manufactured, Si oxide or Mn oxide may be excessively formed in a welded zone such that a penetrator defect rate may increase, which may not be preferable. That is because, as a melting point of oxide formed in a molten zone may increase in manufacturing an electric resistance welded steel pipe such that the likelihood that the oxide remains in a welded zone in compressing and discharging processes may increase.

Thus, in the present disclosure, it may be preferable to satisfy the above-described content range and also to satisfy relational formula 1.

A remainder of the present disclosure is iron (Fe). However, in a general manufacturing process, inevitable impurities may be inevitably added from raw materials or an ambient environment, and thus, impurities may not be excluded. A person skilled in the art of a general manufacturing process may be aware of the impurities, and thus, the descriptions of the impurities may not be provided in the present disclosure.

The hot-rolled steel sheet of the present disclosure which may satisfy the above-described alloy composition and relational formula 1 may have a microstructure including a hard phase including martensite and bainite mixed therein with a ferrite phase as a matrix structure, preferably.

In this case, it may be preferable to include 60-85% of a ferrite phase by area fraction. When a fraction of a ferrite phase is less than 60%, an elongation rate of steel may rapidly decrease. When a fraction thereof exceeds 85%, a fraction of a hard phase (bainite and martensite) may relatively decrease such that a target strength may not be secured.

Also, in the present disclosure, it may be preferable to include a grain in which a martensite (M) phase and a bainite (B) phase are mixed in a hard phase, a grain in which an M phase and a B phase are present in a prior austenite grain. It may be more preferable to include 60% or higher of such a grain in a total hard phase fraction (area fraction). A reminder other than a grain in which an M phase and a B phase are mixed in a hard phase may be a martensite single phase and/or bainite single phase structure.

Referring to the drawings, FIG. 1 shows an image of structure (a) of inventive steel according to an example embodiment of the present disclosure, a grain of a structure occupying 60% or higher of a total hard phase by area fraction, and a result (b) of measuring a content of carbon in each different section of the grain, and it has been confirmed that there was a difference in content of carbon between a region around a grain boundary and a central region, which may indicate that a martensite phase was present around a grain boundary and a bainite pahse was present in a central region in a single grain in which a martensite phase and a bainite phase are mixed.

As described above, in the present disclosure, a bainite phase which has relatively excellent thermal stability may be sufficiently secured, differently from prior DP steel, such that a phenomenon of strength softening in a welding heat affected zone after electric resistance welding may be significantly reduced. Also, by implementing a low yield ratio, pipemaking properties of an electric resistance welded steel pipe may improve, which may be advantageous.

According to an aspect of the present disclosure, a structure phase in which a martensite phase is present around a grain boundary and a bainite phase is present in a central region may be defined as $SSG_{M+B}$, and fractions of $SSG_{M+B}$, a bainite (B) phase, and a martensite (M) phase may satisfy relational formula 2 as below, preferably.

Specifically, when a fraction relationship between hard phases represented by relational formula 2 is less than 0.6, a fraction of a phase ($SSG_{M+B}$) in which a bainite phase and a martensite phase are mixed in a grain may decrease such that a range of decrease of strength of a welding heat affected zone formed in an electric resistance welding may increase, which may be a problem.

$$SSG_{M+B}/(M+B+SSG_{M+B})\geq 0.6 \quad \text{[Relational Formula 2]}$$

(in the relational formula, M refers to a martensite phase, B refers to a bainite phase, and $SSG_{M+B}$ refers to a hard phase in which B and M phases are mixed in a single grain, a structure in which an M phase is present around a grain boundary, and a B phase is present in a central region. Also, each phase is represented by area fraction (%)).

Meanwhile, a (Ti,Nb)C based and/or (V,Nb)C based precipitate may be included in a grain of a ferrite phase included in the hot-rolled steel sheet of the present disclosure to satisfy relational formula 3 as below, preferably.

In the present disclosure, by forming a (Ti,Nb)C based and/or (V,Nb)C based precipitate in a ferrite grain to satisfy relational formula 3 as below, fine cracks may be prevented in a region near a boundary between ferrite and a hard phase, and accordingly, there may be an effect of securing excellent durability after pipemaking and forming of the hot-rolled steel sheet.

$$\phi=\Sigma_{d=0}^{20}PN\times(\Sigma_{d=10}^{20}PN+\Sigma_{d=20}^{50}PN+\Sigma_{d=50}^{100}PN)^{-1}\geq 0.65 \quad \text{[Relational Formula 3]}$$

(PN refers to the number of a (Ti,Nb)C based and/or (V,Nb)C based precipitate in a structure of the hot-rolled steel sheet, and d refers to a diameter (equivalent circular reference) of a composite precipitate observed using a transmission electron microscope (TEM), and a unit thereof is nm).

As described above, the hot-rolled steel sheet of the present disclosure which may satisfy the alloy composition, relational formula 1, and the microstructure may have tensile strength of 590 MPa or higher, and may have a yield ratio (YR=YS/TS) of 0.65-0.85.

Also, the hot-rolled steel sheet of the present disclosure may have 15 or lower of a vickers hardness difference (AHv) between a ferrite phase and a hard phase, and may secure 60(×ten thousand cycles) or higher of durability fatigue lifespan, thereby securing excellent durability.

In the description below, a method of manufacturing a hot-rolled steel sheet having excellent durability provided in the present disclosure, another aspect of the present disclosure, will be described in detail.

Briefly, in the present disclosure, a target hot-rolled steel sheet may be manufactured by undergoing [reheating a steel slab-hot-rolling-primary cooling-secondary cooling-tertiary cooling-coiling] processes, and conditions of each stage will be described in detail below.

[Reheating]

A steel slab satisfying the above-described alloy composition and relational formula 1 may be prepared, and may be reheated in a temperature range of 1180-1300° C., preferably.

When the reheating temperature is less than 1180° C., thermal maturation of the slab may not be sufficient such that there may be a difficulty in securing a temperature in a subsequent hot-rolling process, and it may be difficult to resolve segregation occurring in continuous casting by diffusion. Also, a precipitate which has been precipitated in continuous casting may not be sufficiently re-solid solute such that it may be difficult to obtain a precipitation strengthening effect in processes subsequent to hot-rolling. When the temperature exceeds 1300° C., strength may degrade due to abnormal grain growth of austenite grain, and a non-uniform structure may be formed.

Thus, in the present disclosure, it may be preferable to reheat the steel slab at 1180-1300° C.

[Hot-Rolling]

It may be preferable to manufacture a hot-rolled steel sheet by hot-rolling the steel slab reheated as above. Finishing hot-rolling may be performed at Ar3 (a ferrite phase transformation initiation temperature) or higher, preferably.

When a temperature in the finishing hot-rolling is less than Ar3, the rolling may be performed after ferrite transformation such that it may be difficult to secure target structure and properties. When the temperature exceeds 1000° C., scale defects may increase on a surface, which may be a problem.

Thus, in the present disclosure, it may be preferable to perform the finishing hot-rolling within a temperature range satisfying Ar3 to 1000° C.

[Primary Cooling]

It may be preferable to cool the hot-rolled steel sheet obtained by the hot-rolling as above, and it may be preferable to perform the cooling in steps.

Firstly, it may be preferable to primarily cool the hot-rolled steel sheet to a temperature range of 550-750° C. at a cooling rate of 20° C./s or higher.

When a temperature at which the primary cooling is terminated is less than 550° C., a microstructure in steel may mainly include a bainite phase such that a ferrite phase may not be obtained as a matrix structure, and accordingly, a sufficient elongation rate and a low yield ratio may not be secured. When the temperature exceeds 750° C., coarse ferrite and pearlite structures may be formed such that desired properties may not be secured.

Also, when the cooling is performed to the above-described temperature range at a cooling rate of less than 20° C./s, ferrite and pearlite phase transformation may occur in the cooling such that a desired level of hard phase may not be secured. An upper limit of the cooling rate may not be particularly limited, and may be appropriately selected in consideration of a cooling facility.

[Secondary Cooling]

It may be preferable to cool (secondary cooling) the hot-rolled steel sheet on which the primary cooling has been completed in an extremely slow cooling section under particular conditions. More specifically, it may be preferable to extremely slowly cool the hot-rolled steel sheet at a cooling rate of 0.05-2.0° C./s within a range in which relational formula 4 as below is satisfied.

$$|t-ta|\leq 2 \quad \text{[Relational Formula 4]}$$

(with respect to the relational formula,

[ta=251+(109[C])+(10.5[Mn])+(22.7[Cr])−(6.1[Si])−(5.4[Sol.Al])−(0.87Temp)+(0.00068Temp^2)] is amended to [ta=251+(109[C])+(10.5[Mn])+(22.7[Cr])−(6.1[Si])−(5.4[Sol.Al])−(0.87Temp)+(0.00068Temp$^2$)], where t refers to a secondary cooling maintaining time (seconds), ta refers to a secondary cooling maintaining time (seconds) for securing an optimal phase fracture, and Temp refers to a secondary cooling intermediate temperature, a temperature of an intermediate point between a secondary cooling initiation point and a secondary cooling termination point. Also, each alloy composition is represented by weight content.)

Relational formula 4 is for obtaining a microstructure aimed in the present disclosure, a microstructure satisfying relational formula 2 mentioned above, and by optimizing an intermediate temperature (Temp) in an extremely slow cooling section and a maintaining time in an extremely slow cooling section, a structure in which a martensite phase and a bainite phase are mixed may be obtained by 60% or higher in a total fraction of a hard phase, and carbon distribution of the structure may also be able to satisfy relational formula 2 mentioned above.

More specifically, ferrite phase transformation from austenite occurs in the primary cooling or in an extremely slow cooling section maintaining time (secondary cooling), carbons may be diffused into retained austenite. In this case, by controlling the intermediate temperature (Temp) and the maintaining time of the extremely slow cooling section to satisfy relational formula 3 above, carbon concentration may rapidly increase only in a portion adjacent to ferrite. In this state, when rear end cooling is initiated, a portion may be transformed into bainite and another portion may be transformed into martensite due to a difference in carbon concentrations such that a structure satisfying relational formula 2 may be secured.

In the case in which relational formula 3 is not satisfied when the secondary cooling is controlled, a structure in which a martensite phase and a bainite phase are mixed may not be obtained, and a general DP steel structure may be formed such that an effective range of yield ratio may not be obtained, and a decrease of hardness may also greatly occur in a welding heat affected zone in an electric resistance welding, which may be a problem.

Also, when a cooling rate exceeds 2.0° C./s while controlling the secondary cooling, a sufficient time for forming carbon distribution of the structure in which a martensite phase and a bainite phase are mixed in a hard phase may not be secured. When the cooling rate is less than 0.05° C./s, a fraction of ferrite may excessively increase such that target structure and properties may not be secured.

[Tertiary Cooling]

After completing the secondary cooling in the extremely slow cooling section, it may be preferable to perform tertiary cooling to a temperature range of room temperature to 400° C. at a cooling rate of 20° C./s or higher. The room temperature may refer to a range of about 15-35° C.

When a temperature at which the tertiary cooling is terminated exceeds 400° C., the temperature may be an Ms (a martenite transformation initiation temperature) or higher, and accordingly, most of a retained non-transformed phase may be transformed into a bainite phase such that a microstructure satisfying relational formula 2 of the present disclosure may not be obtained.

Also, when a cooling rate is less than 20° C./s in the tertiary cooling, a bainite phase may be excessively formed such that properties and a microstructure aimed in the present disclosure may not be obtained. An upper limit of the cooling rate may not be particularly limited, and may be appropriately selected in consideration of a cooling facility.

[Coiling]

It may be preferable to perform a coiling process on the hot-rolled steel sheet on which the tertiary cooling has been completed as above at the current temperature.

The present disclosure may further include natural-cooling the coiled hot-rolled steel sheet to a temperature range of room temperature to 200° C., performing a pickling treatment to remove surface layer scales, and performing oil-coating. When a temperature of the steel sheet before the pickling treatment exceeds 200° C., a surface layer of the hot-rolled steel sheet may be overly pickled such that roughness of the surface layer may degrade.

The present disclosure provides an electric resistance welded steel pipe manufactured by electric resistance welding the hot-rolled steel sheet manufactured as above, and there may be an effect that the electric resistance welded steel pipe may have excellent durability.

In the description below, an example embodiment of the present disclosure will be described in greater detail. It should be noted that the example embodiments are provided to describe the present disclosure in greater detail, and to not limit the present disclosure. The scope of rights of the present disclosure may be determined based on the matters recited in the claims and the matters rationally inferred therefrom.

MODE FOR INVENTION

Embodiment

Steel slabs having component systems indicated in Table 1 below were prepared, each steel slab was heated to 1250° C., and finishing hot-rolling (a finishing hot-rolling temperature was listed in Table 2) was performed, thereby manufacturing a hot-rolled steel sheet having a thickness of 3.0 mmt. Thereafter, primary cooling was performed at a cooling rate of 80° C./s, controlled cooing (secondary cooling) was performed with an intermediate temperature and a maintaining time of an extremely slow cooling section listed in Table 2 below, tertiary cooling was performed to room temperature at a cooling rate of 60° C./s, and coiling was performed.

After 3000-times zoomed SEM image of each of the hot-rolled steel sheet manufactured as above was obtained, an area fraction (area %) of each phase (ferrite: F, martensite: M, and bainite: B) was measured using an image analyzer. A structure ($SSG_{M+G}$) in which a martensite phase and a bainite phase were mixed in a hard phase was distinguished by measuring distribution of carbon (C) with respect to a hard phase observed on an SEM phase using a line scanning method of EPMA, and an area fraction (area %) was calculated using the same image analyzer.

Also, precipitate distribution behavior in a ferrite grain was analyzed using an TEM analysis method. Specifically, 10000-times zoomed images of random 10 regions of a structure sample of each hot-rolled steel sheet were obtained, and whether a precipitate was present was observed through TEM component analysis. Also, an average diameter (equivalent circular reference) was calculated based on the obtained images, and size distribution of a precipitate was calculated.

No. JIS5 sample was prepared with respect to each hot-rolled steel sheet, and a tensile test was conducted at room temperature at a deformation rate of 10 mm/min.

Also, a pipe having a diameter of 101.6Φ was made by electric resistance welding of each hot-rolled steel sheet, and cold-forming was performed using a CTBA tube. Thereafter, durability fatigue lifespan was measured under conditions of a frequency of 3.0 Hz and amplitude of ±80 mm.

The results obtained from the above examinations were listed in Tables 3 and 4.

TABLE 1

| | Alloy Composition (weight %) | | | | | | | | | | | Relational |
|---|---|---|---|---|---|---|---|---|---|---|---|---|
| Classification | C | Si | Mn | P | S | Cr | Ti | Nb | V | Sol. Al | N | Formula 1 |
| Inventive Steel 1 | 0.09 | 0.25 | 1.41 | 0.02 | 0.003 | 0.5 | 0.01 | 0.05 | 0.05 | 0.22 | 0.004 | 5.6 |
| Inventive Steel 2 | 0.11 | 0.23 | 1.04 | 0.02 | 0.003 | 0.7 | 0.01 | 0.05 | 0.05 | 0.21 | 0.004 | 4.5 |
| Inventive Steel 3 | 0.09 | 0.25 | 1.52 | 0.01 | 0.003 | 0.6 | 0.01 | 0.04 | 0.07 | 0.21 | 0.003 | 6.1 |
| Inventive Steel 4 | 0.08 | 0.15 | 1.35 | 0.01 | 0.004 | 0.5 | 0.01 | 0.05 | 0.06 | 0.22 | 0.003 | 9.0 |
| Inventive Steel 5 | 0.08 | 0.39 | 1.72 | 0.01 | 0.004 | 0.5 | 0.01 | 0.04 | 0.09 | 0.21 | 0.004 | 4.4 |
| Inventive Steel 6 | 0.11 | 0.41 | 1.71 | 0.02 | 0.003 | 0.5 | 0.01 | 0.05 | 0.05 | 0.23 | 0.003 | 4.2 |
| Inventive Steel 7 | 0.07 | 0.22 | 1.42 | 0.01 | 0.003 | 0.6 | 0.01 | 0.04 | 0.06 | 0.29 | 0.005 | 6.5 |
| Inventive Steel 8 | 0.09 | 0.28 | 1.21 | 0.02 | 0.004 | 0.7 | 0.01 | 0.05 | 0.06 | 0.24 | 0.003 | 4.3 |
| Inventive Steel 9 | 0.09 | 0.29 | 1.25 | 0.02 | 0.005 | 0.6 | 0.04 | 0.04 | 0.07 | 0.31 | 0.004 | 4.3 |
| Inventive Steel 10 | 0.13 | 0.22 | 1.17 | 0.01 | 0.003 | 0.5 | 0.01 | 0.05 | 0.06 | 0.27 | 0.008 | 5.3 |
| Comparative Steel 1 | 0.19 | 0.23 | 1.41 | 0.01 | 0.003 | 0.5 | 0.03 | 0.05 | 0.06 | 0.27 | 0.003 | 6.1 |
| Comparative Steel 2 | 0.01 | 0.25 | 1.12 | 0.02 | 0.004 | 0.5 | 0.03 | 0.04 | 0.09 | 0.39 | 0.004 | 4.5 |
| Comparative Steel 3 | 0.09 | 2.11 | 1.41 | 0.01 | 0.003 | 0.5 | 0.03 | 0.05 | 0.05 | 0.24 | 0.003 | 0.7 |
| Comparative Steel 4 | 0.1 | 0.01 | 1.46 | 0.01 | 0.003 | 0.6 | 0.03 | 0.04 | 0.06 | 0.24 | 0.003 | 146.0 |
| Comparative Steel 5 | 0.1 | 0.21 | 2.32 | 0.02 | 0.005 | 0.5 | 0.03 | 0.04 | 0.05 | 0.22 | 0.004 | 11.0 |
| Comparative Steel 6 | 0.12 | 0.21 | 0.71 | 0.02 | 0.004 | 0.5 | 0.03 | 0.05 | 0.06 | 0.21 | 0.003 | 3.4 |
| Comparative Steel 7 | 0.09 | 0.23 | 1.41 | 0.01 | 0.003 | 1.1 | 0.03 | 0.04 | 0.06 | 0.31 | 0.003 | 6.1 |
| Comparative Steel 8 | 0.09 | 0.29 | 1.41 | 0.01 | 0.003 | 0.2 | 0.03 | 0.05 | 0.07 | 0.31 | 0.003 | 4.9 |
| Comparative Steel 9 | 0.11 | 0.28 | 1.32 | 0.02 | 0.004 | 0.7 | 0.01 | 0.04 | 0.05 | 0.05 | 0.003 | 4.7 |
| Comparative Steel 10 | 0.11 | 0.27 | 1.71 | 0.02 | 0.005 | 0.7 | 0.04 | 0.05 | 0.07 | 0.55 | 0.003 | 6.3 |
| Comparative Steel 11 | 0.09 | 0.35 | 1.71 | 0.02 | 0.003 | 0.5 | 0.01 | 0.07 | 0.05 | 0.23 | 0.003 | 4.9 |
| Comparative Steel 12 | 0.07 | 0.22 | 1.42 | 0.01 | 0.003 | 0.6 | 0.01 | 0.02 | 0.06 | 0.29 | 0.005 | 6.5 |
| Comparative Steel 13 | 0.09 | 0.28 | 1.18 | 0.02 | 0.004 | 0.7 | 0.01 | 0.05 | 0.15 | 0.24 | 0.003 | 4.2 |
| Comparative Steel 14 | 0.09 | 0.29 | 1.24 | 0.02 | 0.005 | 0.6 | 0.04 | 0.04 | 0.03 | 0.31 | 0.004 | 4.3 |
| Inventive Steel 11 | 0.12 | 0.25 | 1.36 | 0.03 | 0.004 | 0.5 | 0.03 | 0.04 | 0.07 | 0.41 | 0.006 | 5.4 |
| Inventive Steel 12 | 0.12 | 0.21 | 1.37 | 0.03 | 0.004 | 0.5 | 0.03 | 0.05 | 0.08 | 0.22 | 0.005 | 6.5 |
| Inventive Steel 13 | 0.11 | 0.27 | 1.42 | 0.02 | 0.004 | 0.5 | 0.03 | 0.04 | 0.05 | 0.31 | 0.003 | 5.3 |
| Inventive Steel 14 | 0.11 | 0.25 | 1.32 | 0.02 | 0.003 | 0.5 | 0.03 | 0.04 | 0.06 | 0.39 | 0.004 | 5.3 |
| Inventive Steel 15 | 0.11 | 0.25 | 1.12 | 0.02 | 0.003 | 0.7 | 0.01 | 0.05 | 0.06 | 0.31 | 0.004 | 4.5 |

TABLE 2

| Steel Type | Finishing Rolling Temperature (° C.) | Primary Cooling Cooling Termination Temperature (° C.) | Secondary Cooling Conditions: Intermediate Temperature (Temp) (° C.) | Maintaining Time (t) (second) | Cooling Rate (° C./s) | Relational Formula 4: ta (second) | \|t − ta\| | Classification |
|---|---|---|---|---|---|---|---|---|
| Inventive Steel 1 | 875 | 640 | 635 | 6 | 1.6 | 6.0 | 0 | Inventive Example 1 |
| Inventive Steel 2 | 880 | 600 | 595 | 10 | 1.1 | 10.4 | 0.4 | Inventive Example 2 |
| Inventive Steel 3 | 878 | 640 | 635 | 9 | 1.1 | 9.5 | 0.5 | Inventive Example 3 |
| Inventive Steel 4 | 872 | 620 | 615 | 6 | 1.7 | 5.3 | 0.7 | Inventive Example 4 |
| Inventive Steel 5 | 877 | 640 | 635 | 8 | 1.1 | 7.4 | 0.6 | Inventive Example 5 |
| Inventive Steel 6 | 880 | 640 | 635 | 10 | 1.1 | 10.3 | 0.3 | Inventive Example 6 |
| Inventive Steel 7 | 870 | 600 | 595 | 9 | 1.4 | 7.3 | 1.7 | Inventive Example 7 |
| Inventive Steel 8 | 880 | 605 | 595 | 10 | 1.8 | 9.5 | 0.5 | Inventive Example 8 |
| Inventive Steel 9 | 875 | 640 | 635 | 7 | 1.2 | 5.9 | 1.1 | Inventive Example 9 |
| Inventive Steel 10 | 890 | 600 | 595 | 9 | 1.2 | 9.1 | 0.1 | Inventive Example 10 |
| Comparative Steel 1 | 900 | 640 | 635 | 10 | 1.3 | 16.7 | 6.7 | Comparative Example 1 |
| Comparative Steel 2 | 870 | 640 | 635 | 6 | 1.7 | −6.7 | 12.7 | Comparative Example 2 |
| Comparative Steel 3 | 890 | 640 | 635 | 6 | 1.7 | −5.5 | 11.5 | Comparative Example 3 |
| Comparative Steel 4 | 875 | 640 | 635 | 10 | 1.7 | 11.2 | 1.2 | Comparative Example 4 |
| Comparative Steel 5 | 877 | 640 | 635 | 10 | 1.2 | 16.9 | 6.9 | Comparative Example 5 |
| Comparative Steel 6 | 880 | 640 | 635 | 6 | 1.7 | 2.2 | 3.8 | Comparative Example 6 |
| Comparative Steel 7 | 870 | 640 | 635 | 10 | 1.5 | 19.3 | 9.3 | Comparative Example 7 |
| Comparative Steel 8 | 870 | 600 | 595 | 6 | 1.7 | −0.2 | 6.2 | Comparative Example 8 |
| Comparative Steel 9 | 870 | 600 | 595 | 10 | 1.7 | 13.8 | 3.8 | Comparative Example 9 |
| Comparative Steel 10 | 890 | 600 | 595 | 10 | 1.7 | 15.3 | 5.3 | Comparative Example 10 |
| Comparative Steel 11 | 870 | 640 | 635 | 10 | 1.7 | 8.5 | 1.5 | Comparative Example 11 |
| Comparative Steel 12 | 878 | 640 | 635 | 7 | 1.7 | 6.0 | 1 | Comparative Example 12 |
| Comparative Steel 13 | 890 | 640 | 635 | 8 | 1.2 | 7.8 | 0.2 | Comparative Example 13 |
| Comparative Steel 14 | 870 | 640 | 635 | 7 | 1.7 | 5.8 | 1.2 | Comparative Example 14 |
| Inventive Steel 11 | 875 | 645 | 635 | 15 | 1.3 | 7.7 | 7.3 | Comparative Example 15 |
| Inventive Steel 12 | 870 | 645 | 520 | 0 | 21.8 | 18.8 | 18.8 | Comparative Example 16 |
| Inventive Steel 13 | 900 | 785 | 780 | 8 | 1.3 | 21.0 | 13 | Comparative Example 17 |
| Inventive Steel 14 | 890 | 525 | 520 | 8 | 1.3 | 16.0 | 8 | Comparative Example 18 |
| Inventive Steel 15 | 870 | 615 | 595 | 10 | 4.1 | 10.5 | 0.5 | Comparative Example 19 |

TABLE 3

| Classification | Microstructure: F | M | B | $SSG_{M+B}$ | Relational Formula 2 | Precipitate: PN20 | PN50 | PN100 | Relational Formula 3 |
|---|---|---|---|---|---|---|---|---|---|
| Inventive Example 1 | 69 | 4 | 2 | 25 | 0.8 | 11120 | 4180 | 0 | 0.7 |
| Inventive Example 2 | 62 | 5 | 3 | 30 | 0.8 | 13730 | 4350 | 10 | 0.8 |
| Inventive Example 3 | 63 | 5 | 2 | 30 | 0.8 | 12650 | 3290 | 0 | 0.8 |
| Inventive Example 4 | 75 | 2 | 2 | 21 | 0.8 | 14410 | 3980 | 10 | 0.8 |
| Inventive Example 5 | 64 | 2 | 3 | 31 | 0.9 | 10270 | 3380 | 0 | 0.8 |
| Inventive Example 6 | 61 | 3 | 3 | 33 | 0.8 | 12410 | 4170 | 0 | 0.7 |
| Inventive Example 7 | 78 | 2 | 2 | 18 | 0.8 | 14950 | 3290 | 0 | 0.8 |
| Inventive Example 8 | 61 | 3 | 4 | 32 | 0.8 | 13210 | 3320 | 0 | 0.8 |
| Inventive Example 9 | 62 | 3 | 4 | 31 | 0.8 | 14428 | 2810 | 10 | 0.8 |
| Inventive Example 10 | 60 | 4 | 5 | 31 | 0.8 | 13940 | 3540 | 0 | 0.8 |
| Comparative Example 1 | 33 | 31 | 21 | 15 | 0.2 | 11170 | 4240 | 0 | 0.7 |
| Comparative Example 2 | 93 | 2 | 5 | 0 | 0 | 12710 | 3990 | 0 | 0.8 |
| Comparative Example 3 | 93 | 3 | 3 | 1 | 0.1 | 12850 | 3780 | 0 | 0.8 |
| Comparative Example 4 | 58 | 3 | 29 | 10 | 0.2 | 11320 | 4070 | 10 | 0.7 |
| Comparative Example 5 | 52 | 9 | 27 | 12 | 0.3 | 12850 | 3510 | 0 | 0.8 |
| Comparative Example 6 | 99 | 0 | 1 | 0 | 0 | 11910 | 3980 | 0 | 0.7 |
| Comparative Example 7 | 59 | 6 | 20 | 15 | 0.4 | 10320 | 4260 | 0 | 0.7 |
| Comparative Example 8 | 90 | 3 | 7 | 0 | 0 | 11630 | 4180 | 10 | 0.7 |
| Comparative Example 9 | 74 | 8 | 12 | 6 | 0.2 | 12650 | 3580 | 0 | 0.8 |
| Comparative Example 10 | 71 | 9 | 9 | 11 | 0.4 | 11910 | 3990 | 0 | 0.7 |
| Comparative Example 11 | 70 | 4 | 2 | 24 | 0.8 | 17930 | 3780 | 0 | 0.8 |
| Comparative Example 12 | 63 | 5 | 3 | 29 | 0.8 | 4420 | 3430 | 0 | 0.6 |
| Comparative Example 13 | 64 | 5 | 2 | 29 | 0.8 | 17550 | 3550 | 0 | 0.8 |
| Comparative Example 14 | 74 | 2 | 2 | 22 | 0.8 | 4370 | 3240 | 0 | 0.6 |
| Comparative Example 15 | 63 | 7 | 28 | 2 | 0.1 | 11810 | 3350 | 0 | 0.8 |
| Comparative Example 16 | 53 | 31 | 14 | 2 | 0.04 | 4310 | 1990 | 10 | 0.7 |
| Comparative Example 17 | 70 | 12 | 17 | 1 | 0.03 | 12610 | 3690 | 0 | 0.8 |
| Comparative Example 18 | 58 | 11 | 27 | 4 | 0.1 | 14950 | 4130 | 0 | 0.8 |
| Comparative Example 19 | 60 | 5 | 28 | 7 | 0.2 | 14330 | 3270 | 0 | 0.8 |

(in Table 3, "F" may refer to a ferrite phase, "M" may refer to a martensite phase, and "B" may refer to a bainite phase)

Also, PN20 refers to the number of precipitates having a diameter of greater than 0 nm and equal to or less than 20 nm, PN50 refers to the number of precipitates having a diameter of greater than 20 nm and equal to or less than 50 nm, and PN100 refers to the number of precipitates having a diameter of greater than 50 nm and equal to or less than 100 nm)

TABLE 4

| | Mechanical Properties of Hot-Rolled Steel Sheet | | | | Properties of Steel Making Material | |
|---|---|---|---|---|---|---|
| Classification | YS (MPa) | TS (MPa) | YR | El (%) | ΔHv | Durability Fatigue Lifespan (×ten thousand cycles) |
| Inventive Example 1 | 680 | 829 | 0.82 | 18 | 9 | 64 |
| Inventive Example 2 | 709 | 875 | 0.81 | 18 | 8 | 62 |
| Inventive Example 3 | 679 | 860 | 0.79 | 18 | 7 | 68 |
| Inventive Example 4 | 636 | 785 | 0.81 | 20 | 10 | 67 |
| Inventive Example 5 | 637 | 817 | 0.78 | 20 | 9 | 63 |
| Inventive Example 6 | 751 | 951 | 0.79 | 19 | 10 | 71 |
| Inventive Example 7 | 540 | 659 | 0.82 | 21 | 11 | 63 |
| Inventive Example 8 | 722 | 870 | 0.83 | 18 | 9 | 66 |
| Inventive Example 9 | 701 | 834 | 0.84 | 19 | 8 | 77 |
| Inventive Example 10 | 713 | 869 | 0.82 | 19 | 8 | 60 |
| Comparative Example 1 | 977 | 1177 | 0.83 | 14 | 47 | 12 |
| Comparative Example 2 | 353 | 430 | 0.82 | 44 | 36 | 9 |
| Comparative Example 3 | 636 | 785 | 0.81 | 19 | 44 | 17 |
| Comparative Example 4 | 687 | 838 | 0.82 | 18 | 42 | 18 |
| Comparative Example 5 | 714 | 871 | 0.82 | 19 | 51 | 12 |
| Comparative Example 6 | 533 | 683 | 0.78 | 22 | 32 | 17 |
| Comparative Example 7 | 671 | 849 | 0.79 | 20 | 49 | 11 |
| Comparative Example 8 | 732 | 871 | 0.84 | 19 | 31 | 17 |
| Comparative Example 9 | 725 | 884 | 0.82 | 20 | 33 | 12 |
| Comparative Example 10 | 724 | 883 | 0.82 | 19 | 39 | 18 |
| Comparative Example 11 | 765 | 860 | 0.89 | 18 | 18 | 52 |
| Comparative Example 12 | 557 | 785 | 0.71 | 19 | 16 | 49 |
| Comparative Example 13 | 719 | 817 | 0.88 | 18 | 18 | 51 |
| Comparative Example 14 | 685 | 951 | 0.72 | 19 | 17 | 47 |
| Comparative Example 15 | 681 | 841 | 0.81 | 19 | 38 | 10 |
| Comparative Example 16 | 677 | 981 | 0.69 | 17 | 46 | 9 |
| Comparative Example 17 | 603 | 913 | 0.66 | 20 | 41 | 8 |
| Comparative Example 18 | 607 | 893 | 0.68 | 19 | 40 | 8 |
| Comparative Example 19 | 617 | 857 | 0.72 | 20 | 39 | 9 |

As indicated in Tables 1 to 4, in each of inventive examples 1 to 10 which satisfied the alloy composition, the component relationship, and the manufacturing conditions suggested in the present disclosure, an intended microstructure was formed, and a precipitate in a ferrite grain satisfied relational formula 3.

As a result, target properties was obtained, and a decrease of hardness of an electric resistance welding heat affected zone may be significantly reduced by uniformly controlling hardness distribution in a structure, and also, excellent durability properties in which durability fatigue lifespan exceeded 600,000 cycles after pipemaking and forming was obtained.

Comparative examples 1 to 14 did not satisfied the alloy composition suggested in the present disclosure.

In comparative example 1, a content of C was excessive, and in comparative example 7, a content of Cr was excessive, and it has been indicated that to values of relational formula 4 of the comparative examples were calculated as 16.7 (seconds) and 19.2 (seconds), respectively. Thus, as for comparative examples 1 and 7, a maintaining time of an extremely slow cooling section (secondary cooling ROT section) for obtaining an optimized phase fraction was excessively required, which exceeded a controllable range of maintaining time in an extremely slow cooling section of the present disclosure. As a result, a structure satisfying relational formula 2 was not obtained.

In comparative examples 2 and 8, contents of C or Cr were insufficient, respectively, and to values of relational formula 4 of the comparative examples were derived as being less than 1 (second), and accordingly, it was difficult to form a grain in which a martensite phase and a bainite phase are mixed in cooling after hot-rolling such that a microstructure intended in the present disclosure was not secured.

In comparative examples 3 and 4, a content of Si was beyond the range of the present disclosure, and in comparative examples 5 and 6, a content of Mn was beyond the range of the present disclosure. In the comparative examples, as a content relationship (corresponding to relational formula 1) between Mn and Si was beyond the present disclosure or a |t|ta| value of relational formula 3 was not satisfied, likelihood of a penetrator defect in a welded zone in welding increased such that cracks were easily created in a welded zone in pipemaking and pipe expanding.

In comparative examples 9 and 10, a content of Al was beyond the range of the present disclosure, and as a |t−ta| value of relational formula 4 exceeded 2, a microstructure intended in the present disclosure was not secured.

In comparative examples 11 and 12, a content of Nb was beyond the range of the present disclosure, and in comparative examples 13 and 14, a content of V was beyond the range of the present disclosure. As for comparative examples 11 and 13 in which contents of Nb and V were excessive, respectively, a yield ratio exceeded 0.85 such that hardness distribution in a structure was not uniform, and durability was deteriorated. Also, as for comparative examples 12 and 14 in which contents of Nb and V were insignificant, respectively, a precipitation effect was not sufficiently obtained, and relational formula 3 was not satisfied.

Comparative examples 15 to 19 are steels of which the alloy composition satisfied the range of the present disclosure and relational formula 1 was satisfied, but as for comparative examples 15 and 16, a maintaining time in cooling was controlled to be 15 seconds and 0 second, respectively, such that a value of |t−ta| of relational formula 4 did not satisfy an effective value. As for comparative examples 17 and 18, primary cooling termination temperatures were too high or too low, respectively, such that relational formula 4 was not satisfied. Also, as for comparative example 19, it has been indicated that a cooling rate in secondary cooling exceeded 2° C./s such that a fraction of bainite was excessively formed.

In both comparative examples 15 and 19, a grain in which a martensite phase and a bainite phase are mixed was rarely formed such that durability was deteriorated after pipemaking and forming.

FIG. 2 shows images of ferrite phases of inventive example 5 and comparative example 14.

In inventive example 5, a precipitate was observed in a ferrite grain, whereas, in comparative example 14, a precipitate was not observed.

The invention claimed is:

1. A hot-rolled steel sheet having excellent durability, comprising:

by weight %, 0.05-0.14% of carbon (C), 0.1-1.0% of silicon (Si), 0.8-1.8% of manganese (Mn), 0.001-0.03% of phosphorous (P), 0.001-0.01% of sulfur (S), 0.1-0.5% of soluble aluminum (Sol.Al), 0.3-1.0% of chromium (Cr), 0.01-0.05% of titanium (Ti), 0.03-0.06% of niobium (Nb), 0.04-0.1% of vanadium (V), 0.001-0.01% of nitrogen (N), and a balance of Fe and inevitable impurities, wherein Mn and Si satisfy relational formula 1 as below, wherein a microstructure includes a hard phase including martensite and bainite phases mixed therein with a ferrite phase as a matrix structure, wherein in a total fracture (area fraction) of a hard phase, a fraction of grains in which a martensite phase and a bainite phase are mixed in a single grain is 60% or higher, and relational formula 2 as below is satisfied, and wherein the hot-rolled steel sheet has durability fatigue lifespan of 60×ten thousand cycles or higher $$4<Mn/Si<12 \quad \text{[Relational Formula 1]}$$

where Mn and Si refer to weight contents of respective elements $$SSG_{M+B}/(M+B+SSG_{M+B})\geq 0.6 \quad \text{[Relational Formula 2]}$$

where M refers to a martensite phase, B refers to a bainite phase, and $SSG_{M+B}$ refers to a hard phase in which B and M phases are mixed in a single grain, a structure in which an M phase is present around a grain boundary, and a B phase is present in a central region, each phase is represented by area fraction (%).

2. The hot-rolled steel sheet of claim 1, wherein a ferrite phase is included by 60-85% in area fraction.

3. The hot-rolled steel sheet of claim 1, wherein a ferrite phase includes a (Ti,Nb)C based and/or (V,Nb)C based precipitate in a grain to satisfy relational formula 3 below:

$$\phi=\Sigma_{d=0}^{20}PN\times(\Sigma_{d=10}^{20}PN+\Sigma_{d=20}^{50}PN+\Sigma_{d=50}^{100}PN)^{-1}\geq 0.65 \quad \text{[Relational Formula 3]}$$

where PN refers to the number of a (Ti,Nb)C based and/or (V,Nb)C based precipitate in a structure of the hot-rolled steel sheet, and d refers to a diameter of a composite precipitate observed using a transmission electron microscope (TEM), and a unit thereof is nm.

4. The hot-rolled steel sheet of claim 1, wherein the hot-rolled steel sheet has tensile strength of 590 MPa or higher, and has a yield ratio (YR=YS/TS) of 0.65-0.85.

5. The hot-rolled steel sheet of claim 1, wherein the hot-rolled steel sheet has 15 or lower of a hardness difference (ΔHv) between a ferrite phase and a hard phase.

6. A method of manufacturing a hot-rolled steel sheet having excellent durability according to claim 1, the method comprising:

reheating a steel slab including, by weight %, 0.05-0.14% of carbon (C), 0.1-1.0% of silicon (Si), 0.8-1.8% of manganese (Mn), 0.001-0.03% of phosphorous (P), 0.001-0.01% of sulfur (S), 0.1-0.5% of soluble aluminum (Sol.Al), 0.3-1.0% of chromium (Cr), 0.01-0.05% of titanium (Ti), 0.03-0.06% of niobium (Nb), 0.04-0.1% of vanadium (V), 0.001-0.01% of nitrogen (N), and a balance of Fe and inevitable impurities, Mn and Si satisfying relational formula 1 as below, at a temperature range of 1180-1300° C.; finishing hot-rolling the reheated steel slab at a temperature of Ar3 or higher and manufacturing a hot-rolled steel sheet; primarily cooling the hot-rolled steel sheet to a temperature range of 550-750° C. at a cooling rate of 20° C./s or higher; performing secondary cooling at a cooling rate of 0.05-2.0° C./s within a range in which relational formula 4 is satisfied, after the primary cooling; performing tertiary cooling to a temperature range of room temperature −400° C. at a cooling rate of 20° C./s or higher, after the secondary cooling; and performing coiling after the tertiary cooling $$4<Mn/Si<12 \quad \text{[Relational Formula 1]}$$

where Mn and Si refer to weight contents of respective elements, $$|t-ta|\leq 2 \quad \text{[Relational Formula 4]}$$

with respect to the relational formula, [ta=251+(109[C])+(10.5[Mn])+(22.7[Cr])−(6.1[Si])−(5.4[Sol.Al])−(0.87Temp)+(0.00068Temp$^2$)], where t refers to a secondary cooling maintaining time (seconds), ta refers to a secondary cooling maintaining time (seconds) for securing an optimal phase fracture, and Temp refers to a secondary cooling intermediate I temperature, the secondary cooling intermediate temperature refers to a temperature of an intermediate point between a secondary cooling initiation point and a secondary cooling termination and each alloy component is represented by weight content; thereby producing the hot-rolled steel sheet of claim 1.

7. The method of claim 6, wherein the finishing hot-rolling is performed in a temperature range of Ar3-1000° C.

8. An electric resistance welded steel pipe manufactured by electric resistance welding the hot-rolled steel sheet of claim 1.

* * * * *